US012298017B2

(12) United States Patent
Najima

(10) Patent No.: US 12,298,017 B2
(45) Date of Patent: May 13, 2025

(54) AIR-CONDITIONING APPARATUS

(71) Applicant: Mitsubishi Electric Corporation, Tokyo (JP)

(72) Inventor: Kohei Najima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 320 days.

(21) Appl. No.: 17/918,935

(22) PCT Filed: Jul. 13, 2020

(86) PCT No.: PCT/JP2020/027281

§ 371 (c)(1),
(2) Date: Oct. 14, 2022

(87) PCT Pub. No.: WO2022/013927

PCT Pub. Date: Jan. 20, 2022

(65) Prior Publication Data

US 2023/0258351 A1 Aug. 17, 2023

(51) Int. Cl.
*F24F 11/38* (2018.01)

(52) U.S. Cl.
CPC ..... *F24F 11/38* (2018.01)

(58) Field of Classification Search
CPC ... F24F 11/38; F25B 13/00; F25B 2313/0233; F25B 2313/0314; F25B 2400/13; F25B 2500/04; F25B 2600/2513; F25B 49/02
See application file for complete search history.

(56) References Cited

U.S. PATENT DOCUMENTS

| | | | | |
|---|---|---|---|---|
| 2017/0314801 | A1 | 11/2017 | Enya et al. | |
| 2018/0045424 | A1* | 2/2018 | Yajima | F24F 7/007 |
| 2019/0285516 | A1* | 9/2019 | Son | F24F 11/30 |
| 2020/0166257 | A1 | 5/2020 | Wada et al. | |

FOREIGN PATENT DOCUMENTS

| | | | |
|---|---|---|---|
| EP | 3 012 556 | A1 | 4/2016 |
| JP | 07-055299 | A | 3/1995 |
| JP | H07-0552999 | * | 3/1995 |
| JP | 2010-230258 | A | 10/2010 |
| JP | 2016-084969 | A | 5/2016 |
| WO | 2014/203356 | A1 | 12/2014 |
| WO | 2019/030885 | A1 | 2/2019 |

OTHER PUBLICATIONS

International Search Report of the International Searching authority mailed Oct. 6, 2020 in corresponding International Patent Application No. PCT/JP2020/027281 (with English translation).

* cited by examiner

*Primary Examiner* — Henry T Crenshaw
(74) *Attorney, Agent, or Firm* — Posz Law Group, PLC

(57) ABSTRACT

The air-conditioning apparatus includes: a refrigerant circuit in which a compressor, an outdoor heat exchanger, the expansion valve, and an indoor heat exchanger are connected by pipes; and a controller. The controller includes a valve opening-degree adjusting module, a flow-rate determination module, and a clogging determination module.

12 Claims, 9 Drawing Sheets

AIR-CONDITIONING APPARATUS

CROSS REFERENCE TO RELATED APPLICATION

This application is a U.S. national stage application of PCT/JP2020/027281 filed on Jul. 13, 2020, the contents of which are incorporated herein by reference.

TECHNICAL FIELD

The present disclosure relates to an air-conditioning apparatus including an expansion valve.

BACKGROUND ART

In air-conditioning apparatuses, for example, as described in Patent Literature 1, refrigerant pipes for an outdoor unit are connected to refrigerant pipes for an indoor unit by extension pipes, whereby a refrigerant circuit is provided. The extension pipes are connected to the refrigerant pipes for the outdoor unit or the indoor unit by welding at the time of installing the outdoor unit or the indoor unit at a designated place.

CITATION LIST

Patent Literature

Patent Literature: International Publication 2019/030885

SUMMARY OF INVENTION

Technical Problem

At the time of installing, for example, the air-conditioning apparatus described in Patent Literature 1, when the extension pipe and the refrigerant pipe are welded together, foreign matter may enter the extension pipe or the refrigerant pipe, which are included in the refrigerant circuit. If foreign matter enters the refrigerant circuit, an expansion valve connected to the refrigerant pipe may be clogged with the foreign matter. As a result, in some cases, the expansion valve does not operate appropriately. If not operating appropriately, the expansion valve cannot appropriately adjust the flow rate of refrigerant. Consequently, refrigerant sucked by a compressor does not completely evaporate, and returns to the compressor in a liquid state. That is, a liquid backflow occurs. If this phenomenon occurs, the compressor cannot normally compress refrigerant and is damaged, and in addition the efficiency of the air-conditioning apparatus is greatly lowered.

The present disclosure is applied to solve the above problem, and relates to an air-conditioning apparatus that can prevent a liquid backflow that will occur when an expansion valve is clogged with foreign matter.

Solution to Problem

An air-conditioning apparatus according to the present disclosure includes: a refrigerant circuit in which a compressor, an outdoor heat exchanger, an expansion valve, and an indoor heat exchanger are connected by pipes; and a controller configured to control an opening degree of the expansion valve. The controller includes: a valve opening-degree adjusting module configured to produce a control signal for control of the opening degree of the expansion valve; a flow-rate determination module configured to compare a flow rate of refrigerant on a downstream side of the expansion valve with a threshold for the flow rate of the refrigerant on the downstream side of the expansion valve; and a clogging determination module configured to determine that the expansion valve is clogged with foreign matter, when the control signal produced by the valve opening-degree adjusting module is a control signal to control the expansion valve such that the opening degree of the expansion valve is made constant or such that the expansion valve is moved in a closing direction in which the expansion valve is closed, and a result of comparison by the flow-rate determination module indicates that the flow rate of the refrigerant on the downstream side of the expansion valve is higher than or equal to the threshold for the flow rate of the refrigerant on the downstream side of the expansion valve.

Advantageous Effects of Invention

In the air-conditioning apparatus according to the present disclosure, the clogging determination module determines whether the expansion valve is closed with foreign matter or not based on the control signal produced by the valve opening-degree adjusting module and the result of the comparison by the flow-rate determination module. Thus, it is possible to handle clogging with the foreign matter in the expansion valve early, and prevent liquid back that would be caused by the clogging with the foreign matter in the expansion valve.

DESCRIPTION OF EMBODIMENTS

An air-conditioning apparatus according to each of embodiments will be described. It should be noted that in figures to be referred to below, relationships in size between components may be different from actual ones. Also, in each of the figures, components that are the same as or equivalent to those in a previous figure or previous figures are denoted by the same reference signs. The same is true of the entire text of the specification. Furthermore, the configurations of components that are described in the entire text of the specification are merely examples, that is, their descriptions are not limiting.

Embodiment 1

<Configuration of Air-Conditioning Apparatus 100>

Figure 1:
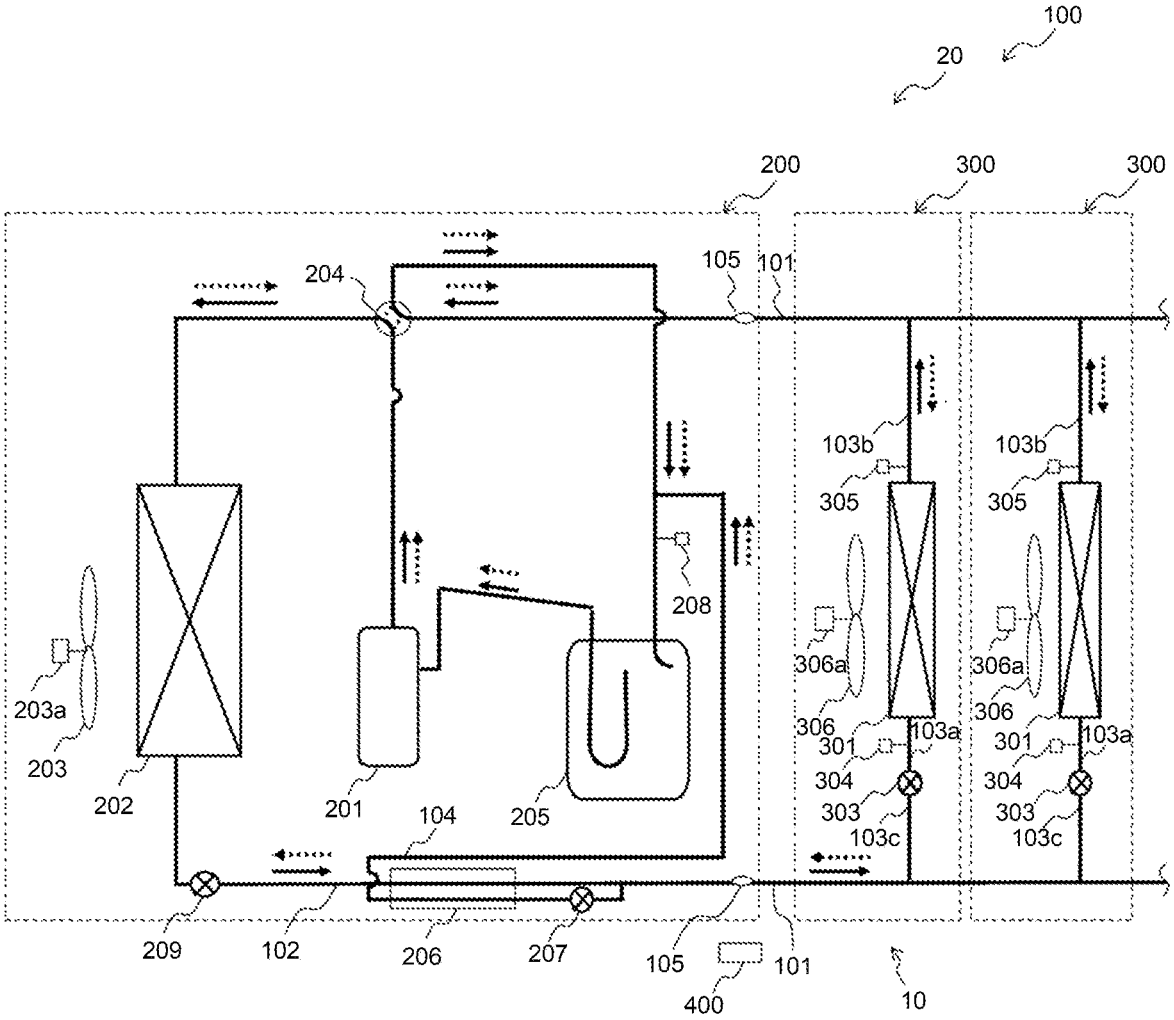
FIG. 1 is a circuit diagram of a refrigerant circuit in an air-conditioning apparatus 100 according to Embodiment 1.

FIG. 1 is a circuit diagram of a refrigerant circuit in an air-conditioning apparatus 100 according to Embodiment 1. In FIG. 1, solid arrows indicate the flows of refrigerant during cooling operation, and dashed arrows indicate the flows of refrigerant during heating operation. As illustrated in FIG. 1, the air-conditioning apparatus 100 includes an outdoor unit 200 and a plurality of indoor units 300. Operations of the outdoor unit 200 and the plurality of indoor units 300 are controlled by, for example, a controller 400.

The outdoor unit 200 and the plurality of indoor units 300 are connected by extension pipes 101. The plurality of indoor units 300 are connected to the outdoor unit 200, and are also connected parallel to each other. A refrigerant circuit 20 is provided in which refrigerant is circulated in the outdoor unit 200 and the plurality of indoor units 300. The refrigerant circuit 20 includes pipes 10 that include refrigerant pipes 102, a bypass pipe 104, first refrigerant pipes 103*a*, second refrigerant pipes 103*b*, third refrigerant pipes 103*c*, and the extension pipes 101.

The controller 400 is, for example, a dedicated hardware or a CPU which executes a program stored in a memory. The CPU is also referred to as a central processing unit, a processing unit, an arithmetic device, a microprocessor, a microcomputer, or a processor.

<Configuration of Outdoor Unit 200>

The outdoor unit 200 is installed, for example, outside a room that is an air-conditioning target space. The outdoor unit 200 includes a compressor 201, an outdoor heat exchanger 202, a flow switching device 204, an accumulator 205, an outdoor expansion valve 209, a refrigerant heat exchanger 206, and a bypass expansion valve 207. The compressor 201, the outdoor heat exchanger 202, the flow switching device 204, the accumulator 205, the outdoor expansion valve 209, and the refrigerant heat exchanger 206 are connected by the refrigerant pipes 102. The bypass expansion valve 207 is connected to the bypass pipe 104, which branches off from the refrigerant pipe 102. The bypass expansion valve 207 will be described in detail later. The outdoor unit 200 also houses an outdoor fan 203 and a first outdoor refrigerant-temperature sensor 208.

The compressor 201 sucks low-temperature and low-pressure refrigerant, compresses the sucked refrigerant to change it into high-temperature and high-pressure refrigerant, and discharges the high-temperature and high-pressure refrigerant. The compressor 201 is, for example, an inverter compressor whose capacity can be controlled. The compressor 201 is controlled by, for example, the controller 400.

The outdoor heat exchanger 202 is, for example, a fin tube heat exchanger that includes a plurality of fins and a plurality of tubes. The outdoor heat exchanger 202 causes heat exchange to be performed between outdoor air and refrigerant that flows in the outdoor heat exchanger 202. The outdoor heat exchanger 202 operates as a condenser during the cooling operation, and operates as an evaporator during the heating operation. The outdoor heat exchanger 202 is not limited to the fin tube heat exchanger, and may be, for example, a plate heat exchanger.

The outdoor fan 203 is a device that sends air to the outdoor heat exchanger 202. The outdoor fan 203 is driven by a motor 203*a* to rotate. The motor 203*a* is controlled by, for example, the controller 400.

The flow switching device 204 switches the flow direction of refrigerant that flows through the refrigerant pipe 102, between a plurality of flow directions, and is, for example, a four-way valve. The flow switching device 204 is connected to a discharge side of the compressor 201, the outdoor heat exchanger 202, the extension pipes 101, and the accumulator 205 by the refrigerant pipes 102. The flow switching device 204 is controlled by, for example, the controller 400.

The accumulator 205 is provided in a refrigerant circuit provided between the flow switching device 204 and a suction side of the compressor 201. The accumulator 205 stores surplus refrigerant that is transiently generated when the operation is changed to, for example, the cooling operation or the heating operation.

The refrigerant heat exchanger 206 causes heat exchange to be performed between refrigerant that flows in the refrigerant pipe 102 and refrigerant that flows in the 15 bypass pipe 104, which branches off from the refrigerant pipe 102. The refrigerant heat exchanger 206 is, for example, a plate heat exchanger.

A strainer 105 is provided at connection part between the extension pipe 101 and the refrigerant pipe 102 in the outdoor unit 200. The strainer 105 is provided to catch foreign matter that mixes into the refrigerant.

<Configuration of Indoor Unit 300>

The plurality of indoor units 300 are provided in respective rooms that are air-conditioning target spaces. One of the plurality of indoor units 300 will be described as follows.

The indoor unit 300 includes an indoor heat exchanger 301 and an indoor expansion valve 303. The indoor heat exchanger 301 and the indoor expansion valve 303 are connected to a refrigerant circuit 20 that includes the first refrigerant pipe 103*a*, the second refrigerant pipe 103*b*, and the third refrigerant pipes 103*c*. The indoor unit 300 also houses an indoor fan 306, a first indoor refrigerant-temperature sensor 304, and a second indoor refrigerant-temperature sensor 305.

The indoor heat exchanger 301 is, for example, a fin tube heat exchanger that includes a plurality of fins and a plurality of tubes. The indoor heat exchanger 301 is connected to the first refrigerant pipe 103*a* and the second refrigerant pipe 103*b*. The first refrigerant pipe 103*a* is a pipe that extends from the indoor heat exchanger 301 to the indoor expansion valve 303. The second refrigerant pipes 103*b* is a pipe that extends from the indoor heat exchanger 301 to the extension pipe 101. The indoor heat exchanger 301 causes heat exchange to be performed between refrigerant that flows in the indoor heat exchanger 301 and air in the air-conditioning target space. The indoor heat exchanger 301 operates as an evaporator during the cooling operation, and operates as a condenser during the heating operation. The indoor heat exchanger 301 is not limited to the fin tube heat exchanger, and may be, for example, a flat heat exchanger.

The indoor fan 306 produces an air current in the air around the indoor heat exchanger 301. The indoor fan 306 is driven by a motor 306*a* to rotate. The motor 306*a* is controlled by, for example, the controller 400.

The indoor expansion valve 303 is a pressure reduction valve or an expansion valve that decompresses the refrigerant to expand the refrigerant. The indoor expansion valve 303 is connected between the first refrigerant pipe 103*a* and the third refrigerant pipe 103*c*. The first refrigerant pipe 103*a* is a pipe that extends from the indoor expansion valve 303 to the indoor heat exchanger 301. The third refrigerant pipe 103*c* is a pipe that extends from the indoor expansion valve 303 to the extension pipe 101. The indoor expansion valve 303 will be described in detail later.

The first indoor refrigerant-temperature sensor 304 and the second indoor refrigerant-temperature sensor 305 are each provided to detect the temperature of the refrigerant.

The first indoor refrigerant-temperature sensor 304 and the second indoor refrigerant-temperature sensor 305 each transmits the detected temperature to the controller 400. The first indoor refrigerant-temperature sensor 304 is provided at the first refrigerant pipe 103*a* which connects the indoor heat exchanger 301 and the indoor expansion valve 303. The second indoor refrigerant-temperature sensor 305 is provided at the second refrigerant pipe 103*b* which extends from the indoor heat exchanger 301.

It should be noted that FIG. 1 illustrates an example in which the strainer 105 is provided at the connection part between the refrigerant pipe 102 and the extension pipe 101, and the location of the strainer 105 is not limited. For example, the strainer 105 can be provided at any of connection parts between the locations of the following components: the first refrigerant pipe 103*a*; the second refrigerant pipes 103*b*; the third refrigerant pipes 103*c*; and the extension pipes 101.

<Operation of Air-Conditioning Apparatus 100>

In the air-conditioning apparatus 100, in the cooling operation, high-temperature and high-pressure gas refrigerant obtained through compression by the compressor 201 flows into the outdoor heat exchanger 202 through the flow switching device 204. The gas refrigerant that has flowed into the outdoor heat exchanger 202 exchanges heat with outdoor air that passes through the outdoor heat exchanger 202 to change into high-pressure liquid refrigerant, and the high-pressure liquid refrigerant then flows out of the outdoor heat exchanger 202. The high-pressure liquid refrigerant that has flowed out of the outdoor heat exchanger 202 flows into the indoor units 300, then flows through the third refrigerant pipes 103*c*, and is decompressed by the indoor expansion valves 303 to change into low-pressure two-phase gas-liquid refrigerant. The low-pressure two-phase gas-liquid refrigerant flows into the indoor heat exchangers 301 through the first refrigerant pipes 103*a* and exchanges heat with indoor air that passes through the indoor heat exchangers 301 to change into low-temperature and low-pressure gas refrigerant. The low-temperature and low-pressure gas refrigerant flows out of the indoor units 300 through the second refrigerant pipe 103*b*, and the gas refrigerant that has flowed out of one of the indoor units 300 and the gas refrigerant that has flowed out of the other indoor unit 300 join each other in the outdoor unit 200. Then, the refrigerant is re-sucked into the compressor 201 through the flow switching device 204 and the accumulator 205.

In the air-conditioning apparatus 100, in the heating operation, high-temperature and high-pressure gas refrigerant obtained through compression by the compressor 201 passes through the flow switching device 204, and flows into the indoor heat exchangers 301 in the indoor units 300 through the second refrigerant pipes 103*b* therein. The gas refrigerant that has flowed into the indoor heat exchangers 301 exchanges heat with indoor air that passes through the indoor heat exchangers 301 to change into high-pressure liquid refrigerant. The high-pressure liquid refrigerant passes through the first refrigerant pipes 103*a*, and is decompressed by the indoor expansion valves 303 to change into low-pressure two-phase gas liquid refrigerant. The low-pressure two-phase gas liquid refrigerant passes through the third refrigerant pipes 103*c*, the low-pressure two-phase gas liquid refrigerant that flows out of one of the third refrigerant pipes 103*c* and the low-pressure two-phase gas liquid refrigerant that flows out of the other third refrigerant pipe 103*c* in the extension pipe 101 join each other to combine into single low-pressure two-phase gas liquid refrigerant, and the single low-pressure two-phase gas liquid refrigerant flows into the outdoor unit 200. Then, the low-pressure two-phase gas liquid refrigerant flows into the outdoor heat exchanger 202 and exchanges heat with outdoor air that passes through the outdoor heat exchanger 202 to change into low-temperature and low-pressure gas refrigerant. The low-temperature and low-pressure gas refrigerant flows out of the outdoor heat exchanger 202, and is re-sucked by the compressor 201 through the flow switching device 204 and the accumulator 205. The bypass pipe 104 supercools the refrigerant using the bypass expansion valve 207 and the refrigerant heat exchanger 206 when it is necessary to supercool the refrigerant in the cooling operation, and then supplies the refrigerant to the indoor unit 300.

<Configuration of Indoor Expansion Valve 303>

Figure 2:
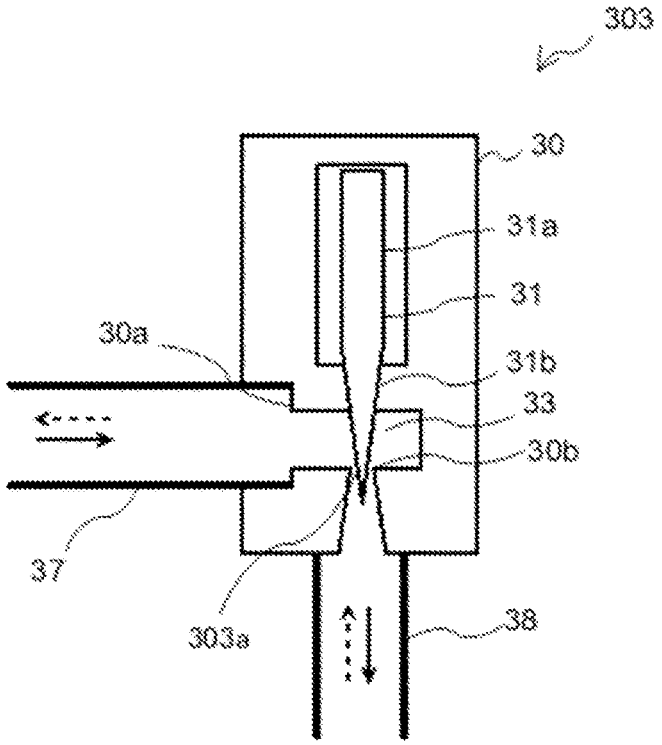
FIG. 2 is a schematic view illustrating an opened state of an indoor expansion valve according to Embodiment 1.
Figure 3:
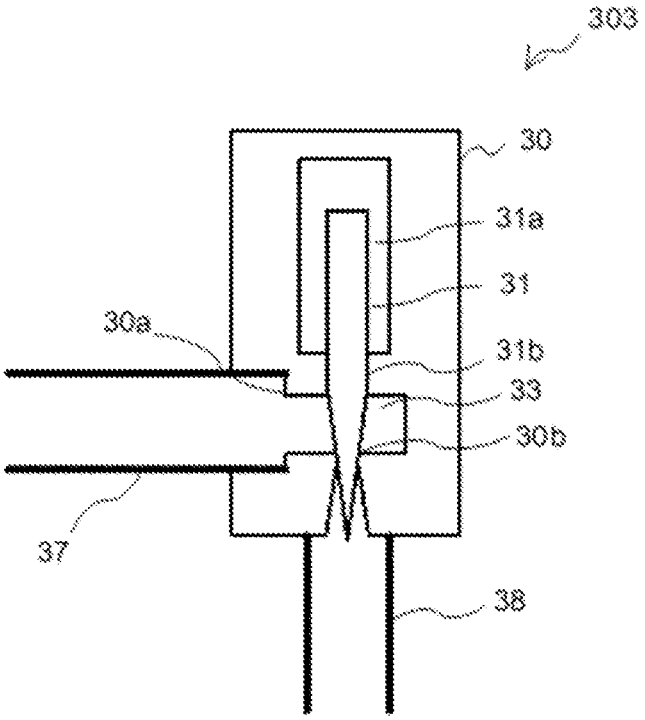
FIG. 3 is a schematic view illustrating a closed state of the indoor expansion valve according to Embodiment 1.

FIG. 2 is a schematic view illustrating an opened state of the indoor expansion valve 303 according to Embodiment 1. FIG. 3 is a schematic view illustrating a dosed state of the indoor expansion valve 303 according to Embodiment 1. In FIG. 2, sold arrows indicate the flow direction of the refrigerant during the cooling operation, and broken arrows indicate the flow direction of the refrigerant in the heating operation, as in FIG. 1. The indoor expansion valve 303 causes the refrigerant to change it into low-temperature and low-pressure refrigerant because of passage of the refrigerant through a narrow space in the expansion valve 303, and automatically adjusts the flow rate and temperature of the refrigerant. The indoor expansion valve 303 is, for example, an electronic expansion valve that uses electromagnetic force produced when current flows a coil.

In the case where the indoor heat exchanger 301 operates as an evaporator, the indoor expansion valve 303 is moved in an opening direction in which the indoor expansion valve 303 is opened, when the second indoor refrigerant-temperature sensor 305 located downstream of the indoor heat exchanger 301 detects that the temperature of the refrigerant rises.

In the case where the indoor heat exchanger 301 operates as an evaporator, the indoor expansion valve 303 is moved in a closing direction in which the indoor expansion valve 303 is closed, when the second indoor refrigerant-temperature sensor 305 located downstream of the indoor heat exchanger 301 detects that the temperature of the refrigerant drops.

As illustrated in FIGS. 2 and 3, the indoor expansion valve 303 includes a main body 30 and a valve body 31 movably provided in the main body 30. The main body has a cylindrical shape and is formed by performing cutting on a foundry piece made of brass.

In the main body 30, a valve chamber 33 is formed. The valve body 31 penetrates the valve chamber 33 and is provided movable in the axial direction of the main body 30. A first through hole 30*a* is formed in a side surface of the main body 30. Also, a second through hole 30*b* is formed on an imaginary line that extends in the moving direction of the valve body 31 in the main body 30.

To the first through hole 30*a*, a first joint pipe 37 is attached. One end of the first joint pipe 37 communicates with the valve chamber 33 through the first through hole 30*a*. The other end of the first joint pipe 37 is connected with the third refrigerant pipe 103*c*. The third refrigerant pipes 103*c* is a pipe that extends to the extension pipe 101.

To the second through hole 30*b*, a second joint pipe 38 is attached. One end of the second joint pipe 38 communicates with the valve chamber 33 through the second through hole 30*b*. The other end of the second joint pipe 38 is connected with the first refrigerant pipe 103*a*. The first refrigerant pipe 103*a* is a pipe that extends to the indoor heat exchanger 301.

A peripheral edge portion of the second through hole 30*b* that adjoins the valve chamber 33 serves as a valve seat. Between the first joint pipe 37 and the second joint pipe 38, a flow passage is provided for refrigerant that flows in the valve chamber 33.

The valve body 31 includes a cylindrical portion 31*a* that forms a shaft portion and a conical portion 31*b* that is provided at one end of the cylindrical portion 31*a*. The cylindrical portion 31*a* and the conical portion 31*b* are formed integral with each other. The valve body 31 is located such that a distal end of the conical portion 31*b* faces the second through hole 30*b* and is movable in the axial direction of the cylindrical portion 31*a*.

As illustrated in FIG. 3, when being driven, the valve body 31 is moved such that the distal end of the conical portion 31*b* is deeply inserted into the second through hole 30*b* and an opening 303*a* defined by an outer peripheral portion of the conical portion 31*b* and the second through hole 30*b* is decreased. When the conical portion 31*b* is brought into contact with the second through hole 30*b*, the indoor expansion valve 303 is fully closed.

As illustrated in FIG. 2, when being driven, the valve body 31 is moved such that the outer peripheral portion of the conical portion 31*b* is separated from the second through hole 30*b* and the area of the opening 303*a* defined by the outer peripheral portion of the conical portion 31*b* and the second through hole 30*b* is increased. When the area of the opening 303*a* defined by the outer peripheral portion of the conical portion 31*b* and the second through hole 30*b* is increased to the maximum, the indoor expansion valve 303 is fully opened.

When the valve body 31 is moved in the axial direction of the cylindrical portion 31*a*, the area of the opening 303*a* defined by the outer peripheral portion of the conical portion 31*b* and the second through hole 30*b* is increased or decreased, and the opening degree of the indoor expansion valve 303 is changed. The opening degree of the indoor expansion valve 303 is changed under the control by the controller 400.

<Operation of Indoor Expansion Valve>

The opening degree of the indoor expansion valve 303 is controlled such that a flow rate Rexp of refrigerant on a downstream side of the indoor expansion valve 303 reaches a target flow rate Rt. The target flow rate Rt is the flow rate of refrigerant that flows in the indoor heat exchanger 301.

When the flow rate Rexp is higher than the target flow rate Rt, the opening degree of the indoor expansion valve 303 is controlled such that the area of the opening 303*a* defined by the outer peripheral portion of the conical portion 31*b* and the second through hole 30*b* is reduced. As a result, the flow rate of the refrigerant on the downstream side of the indoor expansion valve 303 is reduced, and the flow rate of the refrigerant that flows in the indoor heat exchanger 301 is thus reduced, and approaches the target flow rate Rt.

By contrast, when the flow rate of the refrigerant that flows in the indoor heat exchanger 301 falls below the target flow rate Rt, the opening degree of the indoor expansion valve 303 is increased by the control, and the flow rate of the refrigerant that flows in the indoor heat exchanger 301 is increased and re-approaches the target flow rate Rt. In such a manner, the indoor expansion valve 303 is automatically adjusted as the need arises such that the flow rate Rexp of the refrigerant that flows in the indoor heat exchanger 301 approaches the target flow rate Rt.

Figure 4:
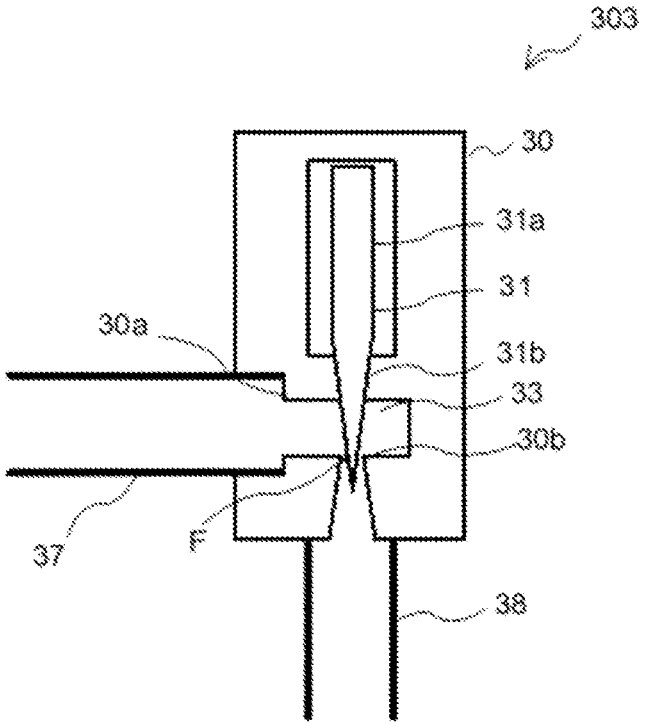
FIG. 4 is a schematic view illustrating a state in which the indoor expansion valve according to Embodiment 1 is clogged with foreign matter.

FIG. 4 is a schematic view illustrating a state in which the indoor expansion valve 303 according to Embodiment 1 is clogged with foreign matter F. As illustrated in FIG. 4, when the indoor expansion valve 303 is clogged with the foreign matter F, the opening 303*a* defined by the outer peripheral portion of the conical portion 31*b* and the second through hole 30*b* is closed.

Even when the opening degree of the indoor expansion valve 303 is controlled to be moved in the closing direction, and then when the flow rate Rexp of the refrigerant on the downstream side of the indoor expansion valve 303 is continuously higher than or equal to a flow-rate threshold Rth, a foreign-matter clogging elimination operation that is an operation of eliminating clogging with foreign matter is performed. The flow-rate threshold Rth is, for example, a value higher than the target flow rate Rt. The case where the flow rate Rexp of the refrigerant on the downstream side of the indoor expansion valve 303 is higher than or equal to the flow-rate threshold Rth corresponds to the case where the flow rate of the refrigerant that flows in the indoor heat exchanger 301 is not decreased, and is kept higher than or equal to the flow-rate threshold Rth.

In the foreign-matter dogging elimination operation, the opening degree of the indoor expansion valve 303 is controlled to be increased to the maximum. When the opening degree of the indoor expansion valve 303 is increased to the maximum, the area of the opening 303*a* defined by the outer peripheral portion of the conical portion 31*b* and the second through hole 30*b* is increased to the maximum. When the area of the opening 303*a* defined by the outer peripheral portion of the conical portion 31*b* and the second through hole 30*b* is increased to the maximum, the flow rate of refrigerant that flows into the opening 303*a* is increased, the foreign matter F with which the opening 303*a* is clogged is pushed out and flows to the downward side of the indoor expansion valve 303. Thus, clogging with the foreign matter can be eliminated.

When the foreign-matter clogging elimination operation ends, the opening degree of the indoor expansion valve 303 is returned to an opening degree that is set by the controller 400 before the foreign-matter clogging elimination operation is performed, and a normal operation is performed. The foreign matter F with which the opening 303*a* is clogged is caught by the strainer 105 located on the downstream side. As a result, the opening degree of the indoor expansion valve 303 is returned from the opening degree of the valve being in an abnormal state in which the valve is clogged with the foreign matter and has not yet been subjected to the foreign-matter clogging elimination operation to the opening degree of the valve being in a normal state.

<Method of Determining Whether Flow Rate Is Higher Than Or Equal to Flow-Rate Threshold Rth>

Whether the flow rate Rexp of the refrigerant on the downstream side of the indoor expansion valve 303 is higher than or equal to the flow-rate threshold Rth can be determined from the degree of superheat at the indoor heat exchanger 301, for example, in the case where the air-conditioning apparatus 100 is in the cooling operation.

In the cooling operation, the indoor heat exchanger 301 operates as an evaporator, and refrigerant that flows out of the indoor expansion valve 303 flows into the indoor heat exchanger 301. When the flow rate of the refrigerant that flows in the indoor heat exchanger 301 is low, the degree of superheat at the indoor heat exchanger 301 is increased, and the difference between the temperature detected by the first indoor refrigerant-temperature sensor 304 and the temperature detected by the second indoor refrigerant-temperature sensor 305 is also increased. By contrast, when the flow rate of the refrigerant that flows in the indoor heat exchanger 301 is high, the degree of superheat at the indoor heat exchanger 301 is decreased, and the difference between the temperature detected by the first indoor refrigerant-temperature sensor 304 and the temperature detected by the second indoor refrigerant-temperature sensor 305 is also decreased.

Therefore, it is possible to determine whether the flow rate Rexp is higher than or equal to the flow-rate threshold Rth or not by determining whether the degree of superheat that is calculated from the difference between the temperature detected by the first indoor refrigerant-temperature sensor 304 and the temperature detected by the second indoor refrigerant-temperature sensor 305 is less than a degree-of-superheat threshold or not.

Furthermore, whether the flow rate Rexp is higher than or equal to the flow-rate threshold Rth or not can be determined from the degree of supercooling at the indoor heat exchanger 301 in the case where the air-conditioning apparatus 100 is in the heating operation.

In the heating operation, the indoor heat exchanger 301 operates as a condenser, and refrigerant that flows into the indoor heat exchanger 301 then flows into the indoor expansion valve 303. When the flow rate of the refrigerant that flows in the indoor heat exchanger 301 is low, the degree of supercooling at the indoor heat exchanger 301 is increased, and the difference between the temperature detected by the first indoor refrigerant-temperature sensor 304 and the temperature detected by the second indoor refrigerant-temperature sensor 305 is also increased. By contrast, when the flow rate of the refrigerant that flows in the indoor heat exchanger 301 is high, the degree of supercooling at the indoor heat exchanger 301 is decreased, and the difference between the temperature detected by the first indoor refrigerant-temperature sensor 304 and the temperature detected by the second indoor refrigerant-temperature sensor 305 is also decreased.

Therefore, it is possible to determine whether the flow rate Rexp is higher than or equal to the flow-rate threshold Rth or not by determining whether the degree of supercooling that is calculated from the difference between the temperature detected by the first indoor refrigerant-temperature sensor 304 and the temperature detected by the second indoor refrigerant-temperature sensor 305 is less than a degree-of-supercooling threshold or not.

<Configuration of Bypass Expansion Valve 207>

The bypass expansion valve 207, as well as the indoor expansion valve 303, includes a first joint pipe 37 and a second joint pipe 38. The bypass expansion valve 207 is moved in the opening direction, when the first outdoor refrigerant-temperature sensor 208, which is provided downstream of the refrigerant heat exchanger 206, detects a temperature rise.

The first joint pipe 37 of the bypass expansion valve 207 is connected to a bypass pipe 104 that extends to the refrigerant pipe 102, and the second joint pipe 38 of the bypass expansion valve 207 is connected to a bypass pipe 104 that extends to the refrigerant heat exchanger 206. The other configuration of the bypass expansion valve 207 is the same as that of the indoor expansion valve 303, and its description will thus be omitted.

<Operation of Bypass Expansion Valve 207>

The bypass expansion valve 207, as well as the indoor expansion valve 303, is controlled in operation degree such that the flow rate Rexp of refrigerant at part of the bypass pipe 104 that is located downstream of the bypass expansion valve 207 reaches the target flow rate Rt. Furthermore, even when the bypass expansion valve 207 is controlled in opening degree to be moved in the closing direction, and when the flow rate Rexp of refrigerant on the downstream side of the bypass expansion valve 207 is continuously higher than or equal to the flow-rate threshold Rth, the foreign-matter clogging elimination operation is performed.

Whether the flow rate Rexp of the refrigerant at the bypass expansion valve 207 is higher than or equal to the flow-rate threshold Rth or not can be determined by determination, for example, on whether the degree of superheat of suction gas at the compressor 201 is less than the degree-of-superheat threshold for the suction gas or not. Therefore, it is possible to determine whether the flow rate Rexp of the refrigerant on the downstream side of the bypass expansion valve 207 is higher than or equal to the flow-rate threshold Rth or not from the degree of superheat of suction gas at the compressor 201 that is based on a detection value obtained by detection by the first outdoor refrigerant-temperature sensor 208. The degree of superheat of the suction gas can be determined from, for example, the difference between the temperature detected by the first outdoor refrigerant-temperature sensor 208 and an evaporation temperature at the evaporator.

<Control in Foreign-Matter Clogging Elimination Operation>

Figure 5:
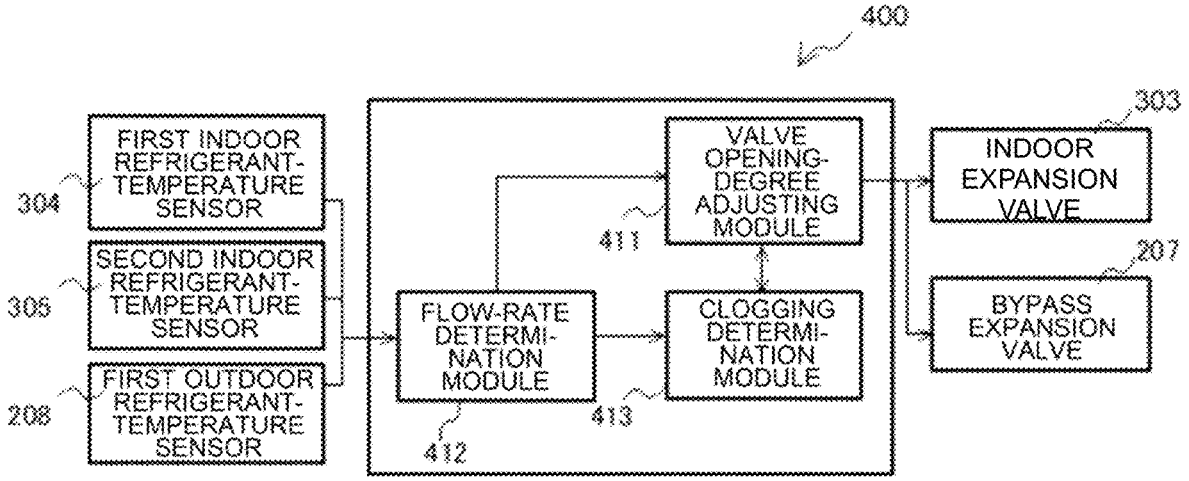
FIG. 5 is a function block diagram of a controller according to Embodiment 1.

FIG. 5 is a function block diagram of the controller 400 according to Embodiment 1. As illustrated in FIG. 5, the controller 400 includes a valve opening-degree adjusting module 411, a flow-rate determination module 412, and a clogging determination module 413. To the flow-rate determination module 412, the first indoor refrigerant-temperature sensor 304, the second indoor refrigerant-temperature sensor 305, and the first outdoor refrigerant-temperature sensor 208 are connected. The valve opening-degree adjusting module 411 is connected to the indoor expansion valve 303.

The valve opening-degree adjusting module 411 produces a control signal for control of the opening degree of the indoor expansion valve 303. Based on the control signal produced by the valve opening-degree adjusting module 411, the indoor expansion valve 303 is driven. The control signal for control of the opening degree is determined, for example, based on a set temperature set at the indoor unit 300.

The flow-rate determination module 412 compares the flow rate Rexp of the refrigerant on the downstream side of the indoor expansion valve 303 with the flow-rate threshold Rth. The comparison between the flow rate Rexp of the refrigerant on the downstream side of the indoor expansion valve 303 and the flow-rate threshold Rth is made, for example, based on the temperatures detected by the first indoor refrigerant-temperature sensor 304 and the second indoor refrigerant-temperature sensor 305.

The clogging determination module 413 determines whether the opening 303*a* of the indoor expansion valve 303 is clogged with foreign matter or not based on the control signal produced by the valve opening-degree adjusting module 411 and the result of the comparison by the flow-rate determination module 412.

More specifically, the clogging determination module 413 receives a control signal for causing the opening degree of the indoor expansion valve 303 to be constant, and determines that clogging with foreign matter occurs, when continuously receiving for first time period T1, a control signal indicating that the flow rate Rexp is higher than or equal to the flow-rate threshold Rth. Furthermore, the clogging determination module 413 receives a control signal for controlling the indoor expansion valve 303 to be moved in the closing direction, and determines that clogging with foreign matter occurs, when continuously receiving for first time period T1, a control signal indicating that the flow rate Rexp is higher than or equal to the flow-rate threshold Rth. The first time period T1 is an example of a certain time period.

The valve opening-degree adjusting module 411 performs the foreign-matter clogging elimination operation, when the clogging determination module 413 determines that clogging with foreign matter occurs. In the foreign-matter clogging elimination operation, the valve opening-degree adjusting module 411 produces a control signal for controlling the opening degree of the indoor expansion valve 303 to be increased to the maximum. Based on the control signal produced by the valve opening-degree adjusting module 411, the indoor expansion valve 303 is driven such that the opening degree thereof is increased to the maximum, and the foreign-matter clogging elimination operation is performed. The foreign-matter clogging elimination operation is continuously performed for second time period T2 that is determined in advance.

Regarding the first time period T1 and the second time period T2, time is measured by a clock module such as a timer, which is provided at the controller 400. The clock module is not illustrated. The first time period T1 is, for example, five minutes, and the second time period T2 is, for example, 1 minute.

It should be noted that although FIG. 5 illustrates by way of example the valve opening-degree adjusting module 411 connected to the indoor expansion valve 303, the valve opening-degree adjusting module 411 can control any expansion valve such as the indoor expansion valve 303 or the bypass expansion valve 207.

<Flowchart of Foreign-Matter Clogging Elimination Operation>

Figure 6:
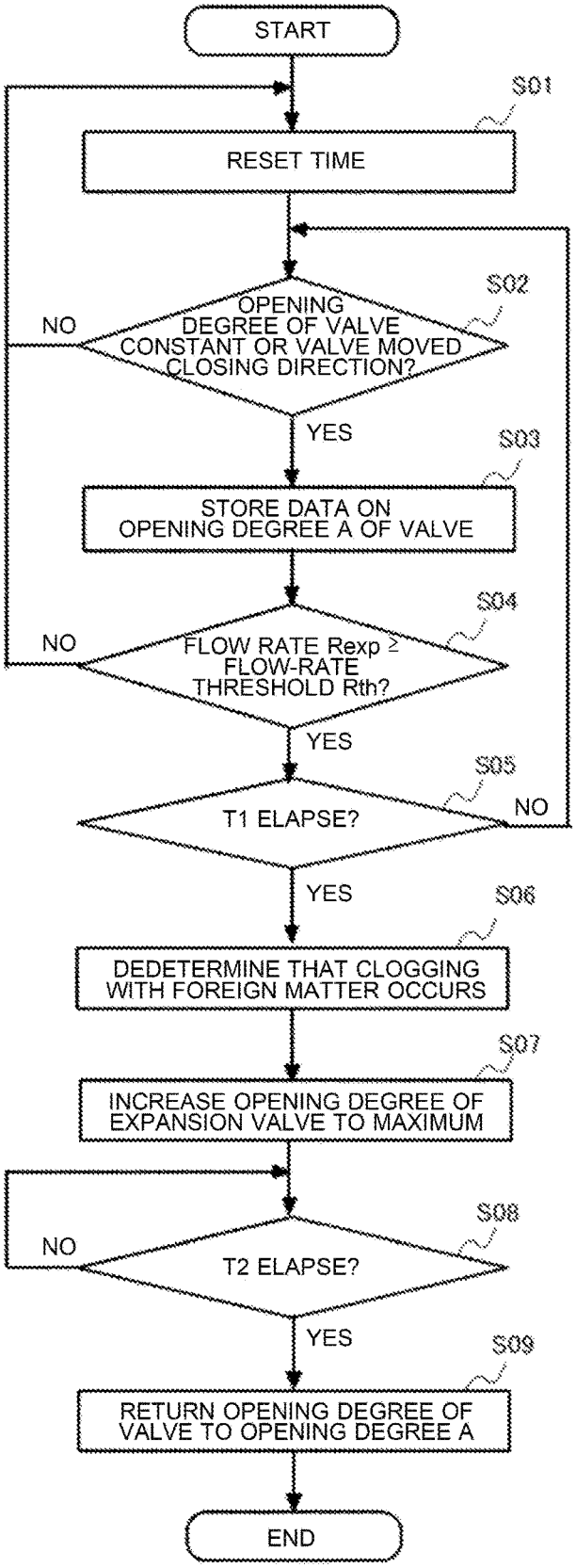
FIG. 6 is a flowchart of a foreign-matter clogging elimination operation according to Embodiment 1.

FIG. 6 is a flowchart of the foreign-matter clogging elimination operation according to Embodiment 1. As illustrated in FIG. 6, in the processing of the foreign-matter clogging elimination operation, first, in step S01, the controller 400 resets the clock module (not illustrated).

In step S02, the valve opening-degree adjusting module 411 determines whether or not the indoor expansion valve 303 is controlled such that the opening degree of the indoor expansion valve 303 is constant or is controlled to be moved in the closing direction. The determination on whether the opening degree of the indoor expansion valve 303 is controlled constant or the indoor expansion valve 303 is controlled to be moved in the closing direction is made based on the control signal produced by the valve opening-degree adjusting module 411. In step S02, when the valve opening-degree adjusting module 411 of the controller 400 determines that the opening degree of the indoor expansion valve 303 is not constant or the indoor expansion valve 303 is not moved in the closing direction, the processing returns to step S01 (No in step S02). By contrast, in step S02, when the valve opening-degree adjusting module 411 of the controller 400 determines that the opening degree of the indoor expansion valve 303 is constant or the indoor expansion valve 303 is moved in the closing direction, the processing proceeds to step S03 (Yes in step S02).

In step S03, the controller 400 stores data on a valve opening degree A, and the processing proceeds to step S04. The valve opening degree A is a valve opening degree to be set originally.

In step S04, the flow-rate determination module 412 determines whether or not the flow rate Rexp of the refrigerant on the downstream side of the indoor expansion valve 303 is higher than or equal to the flow-rate threshold Rth.

In step S04, when the flow-rate determination module 412 determines that the flow rate Rexp of the refrigerant on the downstream side of the indoor expansion valve 303 is less than the flow-rate threshold Rth, the processing returns to step S01 (NO in step S04).

In step S04, when the flow-rate determination module 412 determines that the flow rate Rexp of the refrigerant on the downstream side of the indoor expansion valve 303 is higher than or equal to the flow-rate threshold Rth, the processing proceeds to step S05 (YES in step S04).

In step S05, the controller 400 determines whether the first time period T1 elapses or not. When the first time period T1 does not elapse, the processing returns to step S02 (NO in step S05). In step S05, when the controller 400 determines that the first time period T1 elapses, the processing proceeds to step S06 (YES in step S05).

In step S06, the clogging determination module 413 determines that the indoor expansion valve 303 is clogged with foreign matter, and the processing proceeds to step S07. That is, when the control signal is a signal for controlling the indoor expansion valve 303 to be constant in opening degree or to be moved in the closing direction, and continuously indicates that the flow rate Rexp is higher than or equal to the flow-rate threshold Rth, for the first time period T1, the clogging determination module 413 determines that clogging with foreign matter occurs.

In step S07, the valve opening-degree adjusting module 411 instructs the indoor expansion valve 303 to be moved such that the opening degree thereof is increased to the maximum, and the processing proceeds to step S08.

In step S08, the controller 400 determines whether the second time period T2 elapses or not, and when the second time period T2 does not elapse, the controller 400 continues to instruct the indoor expansion valve 303 to be moved such that the opening degree thereof is increased to the maximum, until the second time period T2 elapses (No in step S08). By contrast, when the controller 400 determines in step S08 that the second time period T2 elapses, the processing proceeds to step S09 (Yes in step S08).

In step S09, the valve opening-degree adjusting module 411 instructs the indoor expansion valve 303 to be moved such that the opening degree thereof is returned to the valve opening degree A. Thus, the processing of the foreign-matter clogging elimination operation ends.

It should be noted that the foreign-matter dogging elimination operation at the bypass expansion valve 207 is performed in the same manner as at the indoor expansion valve 303. In this case, the comparison between the flow rate Rexp of the refrigerant on the downstream side of the bypass expansion valve 207 and the flow-rate threshold Rth is made based on the degree of superheat of suction gas at the compressor 201 that is based on a detection value obtained by detection by the first outdoor refrigerant-temperature sensor 208. The other controls are the same as those in the foreign-matter clogging elimination operation at the indoor expansion valve 303.

In the air-conditioning apparatus 100 according to Embodiment 1 as described above, the clogging determination module 413 determines that clogging with foreign matter occurs, based on the control signal produced by the valve opening-degree adjusting module 411 and the result of the comparison by the flow-rate determination module 412. That is, the control of the opening degree of the indoor expansion valve 303 is performed such that the opening degree thereof is made constant or the indoor expansion valve 303 is moved in the closing direction, by the valve opening-degree adjusting module 411 and the flow-rate determination module 412, and it is determined whether or not the flow rate Rexp of the refrigerant on the downstream side of the indoor expansion valve 303 continues to be higher than or equal to the flow-rate threshold Rth. When it is determined that the flow rate Rexp of the refrigerant on the downstream side of the indoor expansion valve 303 continues to be higher than or equal to the flow-rate threshold Rth, it is determined that the indoor expansion valve 303 is clogged with foreign matter. Thus, in Embodiment 1, it is possible to early eliminate clogging with foreign matter, prevent a liquid back that would be caused by the clogging with foreign matter, and reduce damage to the compressor 201.

When the degree of superheat at the indoor heat exchanger 301 is less than the degree-of-superheat threshold, the clogging determination module 413 determines that the flow rate Rexp of the refrigerant on the downstream side of the indoor expansion valve 303 is higher than or equal to the flow-rate threshold Rth. The degree of superheat at the indoor heat exchanger 301 can be determined from the difference between the temperature detected by the first indoor refrigerant-temperature sensor 304 and that by the second indoor refrigerant-temperature sensor 305. Thus, an additional structure is not required, and it is possible to determine whether clogging with foreign matter occurs or not based on detection values obtained by the provided sensors.

When the degree of supercooling at the indoor heat exchanger 301 is less than a degree-of-supercooling threshold, the clogging determination module 413 determines that the flow rate Rexp of the refrigerant on the downstream side of the indoor expansion valve 303 is higher than or equal to the flow-rate threshold Rth. The degree of supercooling at the indoor heat exchanger 301 can be determined from the temperatures detected by the first indoor refrigerant-temperature sensor 304 and the second indoor refrigerant-temperature sensor 305. Thus, an additional structure is not required, and it is possible to determine whether clogging with foreign matter occurs or not based on detection values obtained by the provided sensors.

When the degree of superheat of the suction gas at the compressor 201 based on a detection value obtained by the first outdoor refrigerant-temperature sensor 208 is less than the degree-of-superheat threshold, the clogging determination module 413 determines that the flow rate Rexp of the refrigerant on the downstream side of the bypass expansion valve 207 is higher than or equal to the flow-rate threshold Rth. Thus, an addition structure is not required, and it is possible to determine whether clogging with foreign matter occurs or not based on values obtained by detection by the provided detectors.

Furthermore, when the clogging determination module 413 determines that clogging with foreign matter occurs, the valve opening-degree adjusting module 411 controls the indoor expansion valve 303 such that the opening degree thereof is increased to the maximum. Thus, the amount of refrigerant that flows into the indoor expansion valve 303 is increased and the foreign matter is pushed out by the refrigerant. It is therefore possible to clear the foreign matter with which the indoor expansion valve 303 is cogged.

<Modification>

Figure 7:
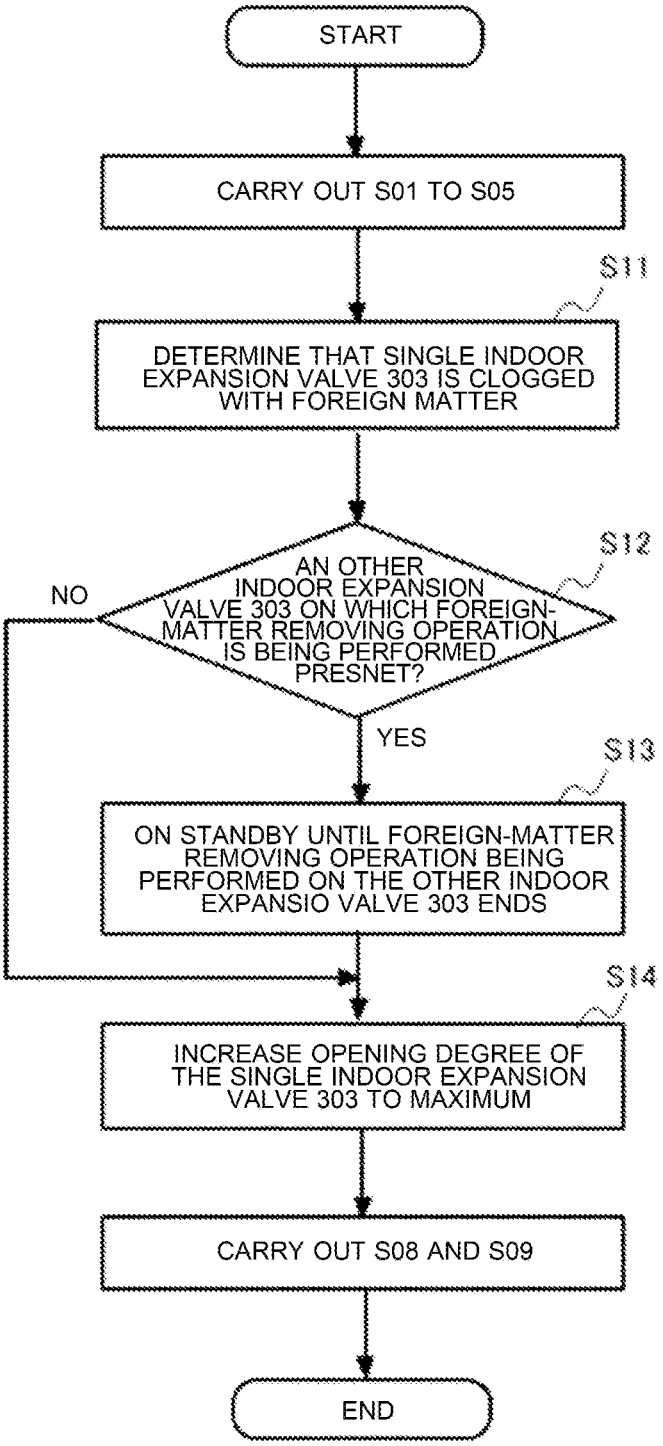
FIG. 7 is a flowchart of the foreign-matter clogging elimination operation in a modification of the foreign-matter clogging elimination operation in an air-conditioning apparatus of a modification of Embodiment 1.

FIG. 7 is a flowchart of the foreign-matter dogging elimination operation in a modification of the foreign-matter dogging elimination operation in an air-conditioning apparatus 100 of a modification of Embodiment 1. In the air-conditioning apparatus 100, in each of the plurality of indoor units 300, there is a possibility that the indoor expansion valve 303 may be clogged with foreign matter.

When it is determined that clogging with foreign matter occurs in the plurality of indoor units 300, the controller 400 causes the indoor expansion valves 303 of the plurality of indoor units 300 to be successively subjected to the foreign-matter clogging elimination operation from a first one of the indoor expansion valves that is first determined to be clogged with foreign matter. In the foreign-matter clogging elimination operation, the opening degree of each of the indoor expansion valves 303 is increased to the maximum.

As illustrated in FIG. 7, the clogging determination module 413 executes the processes of step S01 to step S05 as indicated in FIG. 6. The clogging determination module 413 executes the processes of step S01 to step S05 on the indoor expansion valves 303 of the plurality of indoor units 300 in parallel.

In step S11, when the clogging determination module 413 determines that one of the indoor expansion valves 303 is clogged with foreign matter, the processing proceeds to step S12.

In step S12, the controller 400 determines, of the indoor expansion valves 303 of the plurality of indoor units 300, whether an indoor expansion valve 303 that is other than the above one indoor expansion valve 303 dogged with foreign matter and that is being subjected to the foreign-matter clogging elimination operation is present or not.

In step S12, the controller 400 determines that an indoor expansion valve 303 that is other than the above one indoor expansion valve 303 and that is being subjected to the foreign-matter dogging elimination operation is present, the processing proceeds to step S13 (YES in step S12). In step S13, the controller 400 is on standby until the foreign-matter clogging elimination operation on the above other indoor expansion valve 303 ends, and the processing proceeds to step S14 after the foreign-matter clogging elimination operation ends.

By contrast, in step S12, when the controller 400 determines that an indoor expansion valve 303 that is other than the above one indoor expansion valve 303 and that is being subjected to the foreign-matter clogging elimination operation is not present, the processing proceeds to step S14 (No in step S12).

Figure 9:
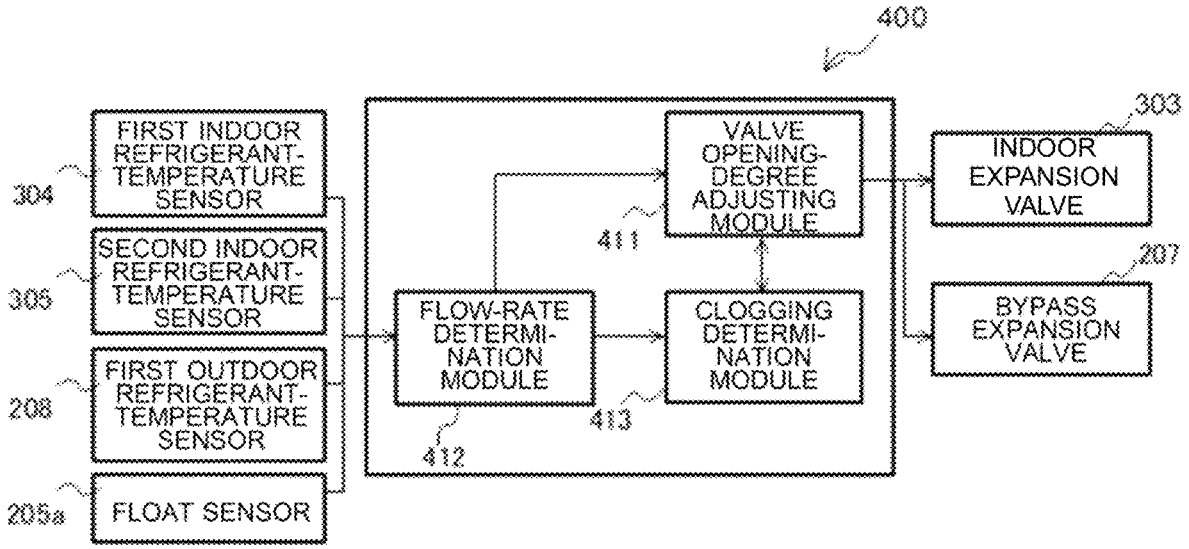
FIG. 9 is a function block diagram of the controller according to Embodiment 2.

In step S14, the valve opening-degree adjusting module 411 controls the above one indoor expansion valve 303 such that the opening degree thereof is increased to the maximum, executes the processes of step S08 to step S09 as indicated in FIG. 9, and ends the processing.

In the air-conditioning apparatus 100 of the modification as described above, when the clogging determination module 413 determines that the plurality of indoor expansion valves 303 are clogged with foreign matter, the valve opening-degree adjusting module 411 controls the indoor expansion valves 303 in turn such that the opening degrees thereof are increased to the maximum. Thus, since the indoor expansion valves 303 are not subjected to the foreign-matter clogging elimination operation at the same time, it is possible to reduce lowering of the operation performance of air-conditioning apparatus 100 during the foreign-matter clogging elimination operation.

Embodiment 2

<Configuration of Air-Conditioning Apparatus 100>

Figure 8:
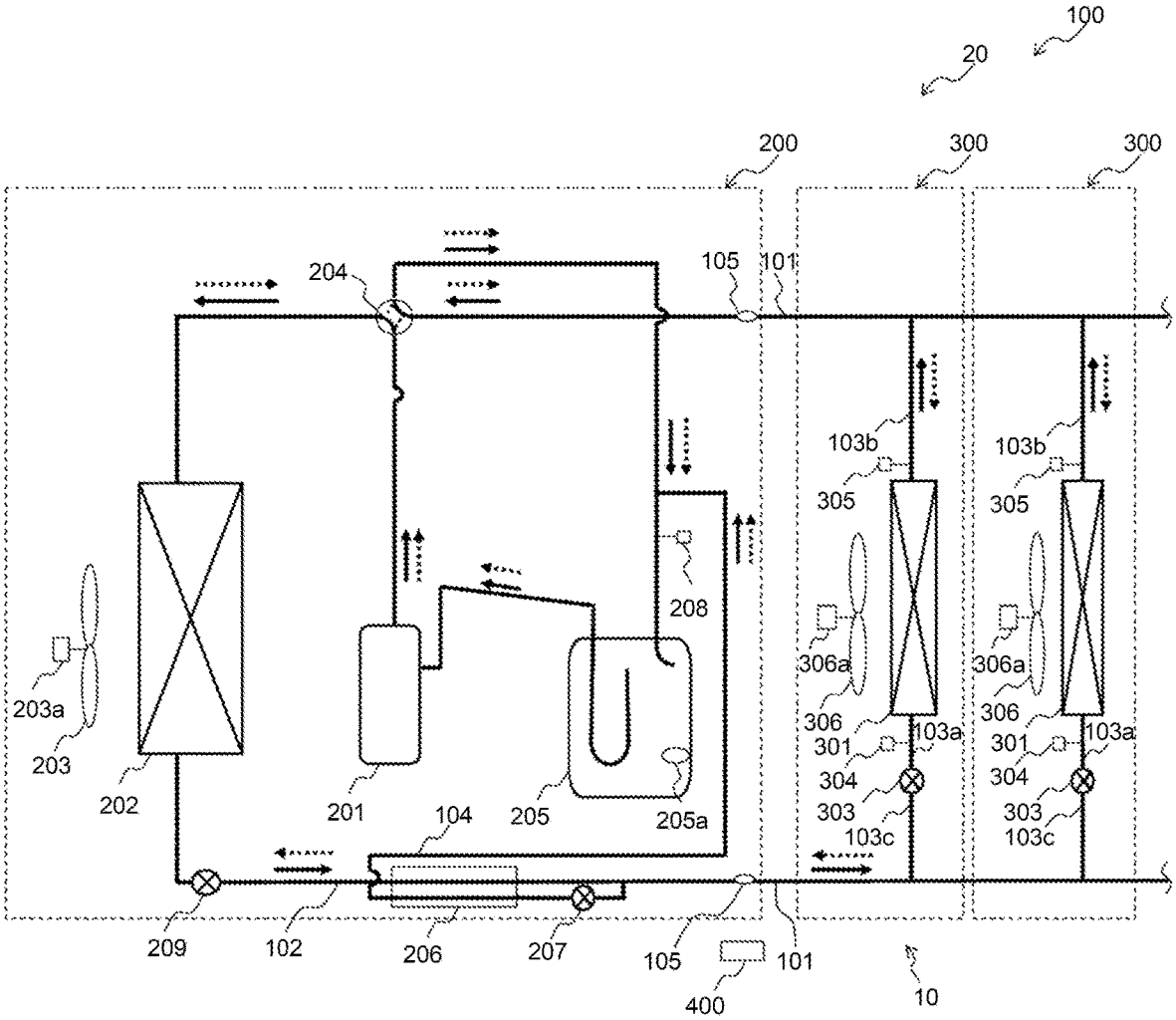
FIG. 8 is a refrigerant circuit diagram of an air-conditioning apparatus according to Embodiment 2.

FIG. 8 is a refrigerant circuit diagram of an air-conditioning apparatus 100 according to Embodiment 2. As illustrated in FIG. 8, in the air-conditioning apparatus 100, the accumulator 205 is provided with a float sensor 205*a*. In this regard, Embodiment 2 is different from Embodiment 1. In Embodiment 2, the other configurations are the same as those in Embodiment 1, their descriptions will thus be omitted, and components that are the same as or equivalent to those in Embodiment 1 will be denoted by the same reference signs.

FIG. 9 is a function block diagram of the controller 400 according to Embodiment 2. As illustrated in FIG. 9, the float sensor 205*a* is connected to the flow-rate determination module 412 which is provided in the controller 400 and to which the first indoor refrigerant-temperature sensor 304 the second indoor refrigerant-temperature sensor 305, and the first outdoor refrigerant-temperature sensor 208 are connected. FIG. 9 illustrates the bypass expansion valve 207, which is one of expansion valves whose opening degrees are adjusted by the valve opening-degree adjusting module 411.

The float sensor 205*a* provided in the accumulator 205 is configured to detect the amount of refrigerant that is stored in the accumulator 205, as a refrigerant amount. The refrigerant amount detected by the float sensor 205*a* is transmitted to the controller 400.

When the refrigerant amount detected by the float sensor 205*a* is increased by a certain amount fora certain time period, the flow-rate determination module 412 determines that the flow rate is higher than or equal to the flow-rate threshold Rth. When the valve opening-degree adjusting module 411 controls the indoor expansion valve 303 such that the opening degree thereof is made constant or the indoor expansion valve 303 is moved in the closing direction, and the flow-rate determination module 412 determines that the flow rate is higher than or equal to the flow-rate threshold Rth, the clogging determination module 413 determines that the bypass expansion valve 207 is clogged with foreign matter. Then, the valve opening-degree adjusting module 411 controls the bypass expansion valve 207 such that the opening degree thereof is increased to the maximum, and performs the foreign-matter clogging elimination operation. In such a manner, it is possible to determine whether or not to perform the foreign-matter clogging elimination operation on the bypass expansion valve 207 on the basis of the foreign-matter clogging elimination operation when an increased amount of the refrigerant amount detected by the float sensor 205*a* is higher than or equal to a refrigerant-amount threshold that is a threshold for the refrigerant amount.

In the air-conditioning apparatus 100 according to Embodiment 2 as described above, the float sensor 205*a* determines that the flow rate Rexp on the downstream side of the bypass expansion valve 207 is higher than or equal to the flow-rate threshold Rth. In such a manner, in the case where the air-conditioning apparatus 100 includes the float sensor 205*a*, an additional structure is not required, and it is possible to determine that clogging with foreign matter occurs, using the value obtained by the detection by the provided sensor.

It should be noted that Embodiments 1 and 2 may be combined.

REFERENCE SIGNS LIST

10: pipe, 20: refrigerant circuit, 30: main body. 30*a*: first through hole, 30*b*: second through hole, 31: valve body, 31*a*: cylindrical portion, 31*b*: conical portion, 33: valve chamber, 37: first joint pipe, 38: second joint pipe, 100: air-conditioning apparatus, 101: extension pipe, 102: refrigerant pipe, 103*a*: first refrigerant pipe, 103*b*: second refrigerant pipe, 103*c*: third refrigerant pipe, 104: bypass pipe, 105: strainer, 200: outdoor unit, 201: compressor, 202: outdoor heat exchanger, 203: outdoor fan, 203*a*: motor, 204: flow switching device, 205: accumulator, 205*a*: float sensor, 206: refrigerant heat exchanger, 207: bypass expansion valve, 208: first outdoor refrigerant-temperature sensor, 209: outdoor expansion valve, 300: indoor unit, 301: indoor heat exchanger, 303: indoor expansion valve, 303*a*: opening, 304: first indoor refrigerant-temperature sensor, 305: second indoor refrigerant-temperature sensor, 306: indoor fan, 306*a*: motor, 400: controller, 411: valve opening-degree adjusting module, 412: flow-rate determination module, 413 clogging determination module

The invention claimed is:

1. An air-conditioning apparatus comprising:

a refrigerant circuit in which a compressor, an outdoor heat exchanger, a plurality of expansion valves, and an indoor heat exchanger are connected by pipes, the plurality of expansion valves including an indoor expansion valve and a bypass expansion valve, each of the expansion valves respectively having an opening degree; and a controller configured to control the opening degree of each of the expansion valves, wherein the controller is configured to, for each of the expansion valves, produce a control signal for control of the opening degree of the expansion valve, compare a flow rate of refrigerant on a downstream side of the expansion valve with a threshold for the flow rate of the refrigerant on the downstream side of the expansion valve, and determine that the expansion valve is clogged with foreign matter, when the control signal is a control signal to control the expansion valve such that the opening degree of the expansion valve is made constant or such that the expansion valve is moved in a closing direction in which the expansion valve is closed, and a result of comparison between the flow rate of the refrigerant on the downstream side of the expansion valve and the threshold for the flow rate of the refrigerant on the downstream side of the expansion valve indicates that the flow rate of the refrigerant on the downstream side of the expansion valve is higher than or equal to the threshold for the flow rate of the refrigerant on the downstream side of the expansion valve, wherein the bypass expansion valve is provided at a bypass pipe that branches off from the pipe connecting the outdoor heat exchanger and the indoor expansion valve and that joins the pipe connected to a suction side of the compressor, and wherein the controller is configured to compare a degree of superheat of suction gas with a threshold for the degree of superheat of the suction gas, thereby comparing the flow rate of the refrigerant on a downstream side of the bypass expansion valve with a threshold for the flow rate of the refrigerant on the downstream side of the bypass expansion valve, and determine that the flow rate of the refrigerant on the downstream side of the bypass expansion valve is higher than or equal to the threshold for the flow rate of the refrigerant on the downstream side of the bypass expansion valve, when the result of the comparison indicates that the degree of superheat of the suction gas is less than the threshold for the degree of superheat of the suction gas.

2. The air-conditioning apparatus of claim 1, wherein the controller is configured to compare a degree of superheat at the indoor heat exchanger with a degree-of-superheat threshold, thereby comparing the flow rate of the refrigerant on the downstream side of the indoor expansion valve with the threshold for the flow rate of the refrigerant on the downstream side of the indoor expansion valve, and determine that the flow rate of the refrigerant on the downstream side of the indoor expansion valve is higher than or equal to the threshold for the flow rate of the refrigerant on the downstream side of the indoor expansion valve, when the result of the comparison indicates that the degree of superheat at the indoor heat exchanger is less than the degree-of-superheat threshold.

3. The air-conditioning apparatus of claim 1, wherein the controller is configured to compare a degree of supercooling at the indoor heat exchanger with a degree-of-supercooling threshold, thereby comparing the flow rate of the refrigerant on the downstream side of the indoor expansion valve with the threshold for the flow rate of the refrigerant on the downstream side of the indoor expansion valve, and determine that the flow rate of the refrigerant on the downstream side of the indoor expansion valve is higher than or equal to the threshold for the flow rate of the refrigerant on the downstream side of the indoor expansion valve, when the result of the comparison by the flow-rate determination module indicates that the degree of supercooling at the indoor heat exchanger is less than the degree-of-supercooling threshold.

4. An air-conditioning apparatus comprising:

a refrigerant circuit in which a compressor, an outdoor heat exchanger, a plurality of expansion valves, and an indoor heat exchanger are connected by pipes, the plurality of expansion valves including an indoor expansion valve and a bypass expansion valve, each of the expansion valves respectively having an opening degree;

a controller configured to control the opening degree of each of the expansion valves; and an accumulator connected to the refrigerant circuit, wherein the controller is configured to, for each of the expansion valves, produce a control signal for control of the opening degree of the expansion valve, compare a flow rate of refrigerant on a downstream side of the expansion valve with a threshold for the flow rate of the refrigerant on the downstream side of the expansion valve, and determine that the expansion valve is clogged with foreign matter, when the control signal is a control signal to control the expansion valve such that the opening degree of the expansion valve is made constant or such that the expansion valve is moved in a closing direction in which the expansion valve is closed, and a result of comparison between the flow rate of the refrigerant on the downstream side of the expansion valve and the threshold for the flow rate of the refrigerant on the downstream side of the expansion valve indicates that the flow rate of the refrigerant on the downstream side of the expansion valve is higher than or equal to the threshold for the flow rate of the refrigerant on the downstream side of the expansion valve, wherein the bypass expansion valve is provided at a bypass pipe that branches off from the pipe connecting between the outdoor heat exchanger and the indoor expansion valve and that joins the pipe connected to a suction side of the compressor, and wherein the controller is configured to compare an increased amount of an amount of refrigerant in the accumulator with a refrigerant-amount threshold that is a threshold for the amount of the refrigerant, thereby comparing the flow rate of the refrigerant on a downstream side of the bypass expansion valve with a threshold for the flow rate of the refrigerant on the downstream side of the bypass expansion valve, and determine that the flow rate of the refrigerant on the downstream side of the bypass expansion valve is higher than or equal to the threshold for the flow rate of the refrigerant on the downstream side of the bypass expansion valve, when the result of the comparison indicates that the increased amount of the amount of the refrigerant in the accumulator is higher than or equal to the refrigerant-amount threshold.

5. The air-conditioning apparatus of claim 1, wherein the controller is configured to control the indoor expansion valve in such a manner as to increase the opening degree of the indoor expansion valve to the maximum, when determining that the indoor expansion valve is clogged with the foreign matter.

6. The air-conditioning apparatus of claim 1, wherein the refrigerant circuit includes a plurality of indoor heat exchangers including the indoor heat exchanger, the plurality of expansion valves includes a plurality of indoor expansion valves including the indoor expansion valve each associated with a respective indoor heat exchanger of the plurality of heat exchangers, wherein the plurality of indoor expansion valves are identical, and the controller is configured to determine that the plurality of indoor expansion valves are clogged with foreign matter, including to control the plurality of indoor expansion valves in turn in such a manner as to respectively increase the opening degree of each of the plurality of indoor expansion valves to the maximum for a time period determined in advance.

7. The air-conditioning apparatus of claim 1, wherein the controller is configured to determine that the indoor expansion valve is clogged with the foreign matter, when the control signal is a control signal to control the indoor expansion valve such that the opening degree of the indoor expansion valve is made constant or the indoor expansion valve is moved in the closing direction, and the result of the comparison indicates that the flow rate of the refrigerant on the downstream side of the indoor expansion valve continues to be higher than or equal to the threshold for the flow rate of the refrigerant on the downstream side of the indoor expansion valve for a certain time period.

8. The air-conditioning apparatus of claim 4, wherein the controller is configured to compare a degree of superheat at the indoor heat exchanger with a degree-of-superheat threshold, thereby comparing the flow rate of the refrigerant on the downstream side of the indoor expansion valve with the threshold for the flow rate of the refrigerant on the downstream side of the indoor expansion valve, and determine that the flow rate of the refrigerant on the downstream side of the indoor expansion valve is higher than or equal to the threshold for the flow rate of the refrigerant on the downstream side of the indoor expansion valve, when the result of the comparison indicates that the degree of superheat at the indoor heat exchanger is less than the degree-of-superheat threshold.

9. The air-conditioning apparatus of claim 4, wherein the controller is configured to compare a degree of supercooling at the indoor heat exchanger with a degree-of-supercooling threshold, thereby comparing the flow rate of the refrigerant on the downstream side of the indoor expansion valve with the threshold for the flow rate of the refrigerant on the downstream side of the indoor expansion valve, and determine that the flow rate of the refrigerant on the downstream side of the indoor expansion valve is higher than or equal to the threshold for the flow rate of the refrigerant on the downstream side of the indoor expansion valve, when the result of the comparison by the flow-rate determination module indicates that the degree of supercooling at the indoor heat exchanger is less than the degree-of-supercooling threshold.

10. The air-conditioning apparatus of claim 4, wherein the controller is configured to control the indoor expansion valve in such a manner as to increase the opening degree of the indoor expansion valve to the maximum, when determining that the indoor expansion valve is clogged with the foreign matter.

11. The air-conditioning apparatus of claim 4, wherein the refrigerant circuit includes a plurality of indoor heat exchangers including the indoor heat exchanger, the plurality of expansion valves includes a plurality of indoor expansion valves including the indoor expansion valve each associated with a respective indoor heat exchanger of the plurality of heat exchangers, wherein the plurality of indoor expansion valves are identical, and the controller is configured to determine that the plurality of indoor expansion valves are clogged with foreign matter, including to control the plurality of indoor expansion valves in turn in such a manner as to respectively increase the opening degree of each of the plurality of indoor expansion valves to the maximum for a time period determined in advance.

12. The air-conditioning apparatus of claim 4, wherein the controller is configured to determine that the indoor expansion valve is clogged with the foreign matter, when the control signal is a control signal to control the indoor expansion valve such that the opening degree of the indoor expansion valve is made constant or the indoor expansion valve is moved in the closing direction, and the result of the comparison indicates that the flow rate of the refrigerant on the downstream side of the indoor expansion valve continues to be higher than or equal to the threshold for the flow rate of the refrigerant on the downstream side of the indoor expansion valve for a certain time period.

* * * * *